US005240244A

United States Patent [19]

Pollich et al.

[11] Patent Number: 5,240,244

[45] Date of Patent: Aug. 31, 1993

[54] PROCESS AND APPARATUS FOR PRESTACKING IN A SHEET FEEDER OF ROTARY PRINTING PRESSES

[75] Inventors: Gerhard Pollich, Heidelberg; Heiner Luxem, Wilhelmsfeld, both of Fed. Rep. of Germany

[73] Assignee: Heidelberger Druckmaschinen Aktiengesellschaft, Heidelberg, Fed. Rep. of Germany

[21] Appl. No.: 820,424

[22] Filed: Jan. 14, 1992

[30] Foreign Application Priority Data

Jan. 15, 1991 [DE] Fed. Rep. of Germany ..... 4100901

[51] Int. Cl.[5] ..... B65H 9/00

[52] U.S. Cl. ..... 271/240; 271/241; 271/248; 271/255; 271/157; 271/164; 271/171

[58] Field of Search ..... 271/145, 152, 157-159, 271/164, 240, 241, 147, 171, 234, 248, 253, 254, 255

[56] References Cited

U.S. PATENT DOCUMENTS

| | | | |
|---|---|---|---|
| 1,395,897 | 11/1921 | Berkowitz | 271/171 |
| 2,639,150 | 5/1953 | Aberle | 271/157 X |
| 2,900,186 | 8/1959 | Schnebel | 271/158 |
| 2,922,647 | 1/1960 | Buttner | 271/171 |
| 3,334,894 | 8/1967 | Van Acker | 271/174 |
| 4,245,830 | 1/1981 | Fichte et al. | 271/164 |
| 4,349,187 | 9/1982 | Weyrich | 271/159 |
| 4,697,804 | 10/1987 | Pollich | 271/162 |
| 4,703,924 | 11/1987 | Marass | 271/9 |
| 4,971,311 | 11/1990 | Tsukimoto | 271/241 X |
| 5,011,126 | 4/1991 | Suzuki et al. | 271/159 X |
| 5,076,562 | 12/1991 | Sai et al. | 271/171 X |

FOREIGN PATENT DOCUMENTS

| | | | |
|---|---|---|---|
| 0253165 | 1/1988 | European Pat. Off. . | |
| 2750105 | 5/1979 | Fed. Rep. of Germany . | |
| 2911735 | 10/1980 | Fed. Rep. of Germany . | |
| 3321724 | 3/1984 | Fed. Rep. of Germany . | |
| 3504491 | 1/1989 | Fed. Rep. of Germany . | |
| 165637 | 12/1981 | Japan | 271/171 |
| 134432 | 6/1988 | Japan | 271/171 |
| 176740 | 7/1989 | Japan | 271/157 |

*Primary Examiner*—Robert P. Olszewski
*Assistant Examiner*—Boris Milef
*Attorney, Agent, or Firm*—Nils H. Ljungman & Associates

[57] ABSTRACT

A process and an apparatus for prestacking in a sheet feeder of a rotary printing press provided with lateral stack stops, which can be adjusted to the format of the sheet to be printed, the printing press also having an automatic lateral stacking orientation and a stack raising apparatus, which are designed so that they make possible an easy manual prestacking in the sheet feeder by the operator.

17 Claims, 5 Drawing Sheets

PROCESS AND APPARATUS FOR PRESTACKING IN A SHEET FEEDER OF ROTARY PRINTING PRESSES

BACKGROUND OF THE INVENTION

1. Field of the Invention

The present invention relates to a process and apparatus for the prestacking of sheets in a sheet feeder of a rotary printing press, the printing press being provided with lateral stack stops that can be adjusted to the size of the sheet format to be processed, and the printing press having an automatic lateral stacking orientation apparatus and a stack raising apparatus.

2. Background Information

DE 27 50 105 A1 and EP 0 253 165 B1 disclose sheet feeders having lateral stops for the sheet stack that can be adjusted by means of servomotors to the size of the sheet format to be printed. The stack stops can be used, for example, to perform a pre-orientation of the sheets to be printed. In addition, the lateral stops can also be used to orient improperly stacked sheets in the upper area, in order to transport the individual sheets in a desired lateral position to the sheet feeder. For this purpose, it is necessary to accurately adjust the lateral stops to the current paper format, which requires that the individual paper layers be formed, outside of the press, into a sheet stack, which is then introduced into the sheet feeder. The heavy sheet stack must thereby be very precisely oriented laterally, so that, when it is raised by the stack raising device, it does not collide with the lateral stack stops.

DE 29 11 735 A1 shows feeler rollers which emit a control signal which is used for the automatic lateral orientation of the sheet stack. An electric motor moves the sheet stack in one direction or the other, so that the top layers of the sheet stack, in their lateral position, coincide with the stack stops.

One disadvantage of these embodiments of the prior art is that the sheet stack can only be filled up outside the press, because the lateral stack stops act only on the top layers of the sheet stack. If the printer, for purposes of prestacking, wants to fill up the sheet stack in the press, he must first lower the sheet stack, to get sufficient space to insert the sheet stack. Then he would not be able to straighten them laterally, so that only with considerable effort could he achieve a perpendicular sheet stack with a uniform lateral position of the sheets.

OBJECT OF THE INVENTION

In view of the above, one object of the present invention is to make possible a simple method for performing prestacking of sheets in the sheet feeder of a rotary printing press.

SUMMARY OF THE INVENTION

This and other objects are achieved by the following process steps: With the paper feed turned off, the remaining stack is first lowered; the lateral stack stops are then placed against the remaining stack by means of positioning means; the new sheet layers are manually inserted between the stack stops and are thereby placed in a straightened position on the remaining stack; and the stack is then raised into the working position, and, simultaneously, the stack stops are removed from the sheet stack by a desired amount, so that the feed stack can be moved laterally.

This solution offers the advantage that the printer can place new sheet layers on the remaining stack in the press, and that these new sheet layers can be exactly oriented. During the printing, the feed stack can be moved laterally, so that a lateral orientation of the individual sheets is possible without rigid stack stops. In this process, it is therefore not necessary to make a precise adjustment of the lateral stack stops, so that if there are sheets not lying in exactly the correct position, their edges will not be damaged.

In an advantageous extension of the process, the lateral position of the sheet feeder stack is monitored by a sensing device, and the format adjustment of the lateral stack stops can also be made by the positioning means themselves.

An apparatus for the execution of the process is characterized by the fact that the lateral stack stops are mounted so that they can move on a crosspiece at right angles to the sheet transport direction, that each stop can be moved separately by means of a threaded spindle and a servomotor, that the stack stops can be moved in a slideway, that the stack stops are each mounted on a holder arm, and that the stack stops cover the majority of the height of the sheet stack.

One feature of the invention resides broadly in a process for the replenishing of an existing stack of sheets of paper, the sheets of paper being fed to a rotary printing press for the printing thereof, the sheets of paper being supplied to the printing press in the form of a substantially vertical stack having opposing lateral sides, and the printing press being provided with conveying apparatus for conveying an uppermost sheet of paper from the stack into the printing press, vertical movement apparatus for moving the stack in a substantially vertical direction, lateral movement apparatus for moving the stack in a substantially lateral direction with respect to the rotary printing press, and at least a pair of lateral stack stops, the lateral stack stops extending substantially vertically, one each of the pair of lateral stack stops aligning with an opposing lateral side of the stack, the process comprising the steps of: actuating the vertical movement means to thereby lower the existing stack; positioning each of the pair of lateral stack stops against the respective opposing lateral side of the existing stack and in contact therewith; forming a plurality of additional sheets into an additional stack, the additional stack also having opposing lateral sides, and placing the additional stack on top of the existing stack and between the pair of lateral stack stops, such that each of the lateral sides of the additional stack is in contact with the opposing lateral stack stop; actuating the vertical movement apparatus to thereby raise the stack, including the existing stack with the additional stack being thusly positioned thereover; and moving each of the pair of lateral stack stops so that they are positioned away from and out of contact with the opposing lateral sides of both the existing stack and the additional stack positioned thereover, whereby both the existing stack and the additional stack positioned thereover can both be moved laterally by the lateral movement means.

Another feature of the invention resides broadly in an apparatus for the replenishing of an existing stack of sheets of paper supplied to a rotary printing press for the printing thereof, the sheets of paper being supplied to the printing press in the form of a substantially vertical stack having opposing lateral sides, the rotary printing press being provided with conveying apparatus for conveying an uppermost sheet of paper from the stack into the printing press in a defined direction sheet transport, said apparatus comprising: vertical movement apparatus for moving the stack in a substantially vertical direction; lateral movement means for moving the stack in a substantially lateral direction with respect to the printing press; at least a pair of lateral stack stops, the lateral stack stops extending substantially vertically, one each of the pair of lateral stack stops aligning with an opposing lateral side of the stack; means for positioning each of the pair of lateral stack stops in a first position against the respective opposing lateral side of the existing stack and in contact therewith; whereby, in the first position, the pair of lateral stack stops provide alignment means for aligning an additional stack comprising a plurality of additional sheets on top of the existing stack and between the pair of lateral stack stops; apparatus for positioning each of the pair of lateral stack stops in a second position wherein each of the pair of lateral stack stops is positioned away from and out of contact with the opposing lateral sides of both the existing stack and the additional stack positioned thereover; whereby, both the existing stack and the additional stack positioned thereover can both be moved laterally by the lateral movement apparatus.

Yet another feature of the invention resides broadly in a process for the feeding of planar sheets of material to a processing machine for the processing thereof, the sheets of material being supplied to the processing machine in the form of a substantially vertical stack, and the processing machine being provided with conveying means for conveying an uppermost sheet of material from the stack into the processing machine, the processing machine also being provided with vertical movement means for moving the stack in a substantially vertical direction, lateral movement means for moving the stack in a substantially lateral direction with respect to the processing machine, and at least a pair of lateral stack stops, the lateral stack stops extending substantially vertically, one each of the pair of lateral stack stops aligning with a lateral edge of the stack, said process comprising the steps of: actuating the vertical movement apparatus to thereby lower the stack; positioning the pair of lateral stack stops against the opposing lateral edges of the stack and in contact therewith; forming a plurality of additional sheets into an additional stack and placing said additional stack on top of the original stack and between the pair of lateral stack stops, the opposing lateral edges of the additional stack being in contact therewith; actuating the vertical movement apparatus to thereby raise the stack, with the additional stack positioned thereover; and moving each of the pair of lateral stack stops so that they are positioned away from and out of contact with the opposing lateral sides of both the existing stack and the additional stack positioned thereover, whereby both the existing stack and the additional stack positioned thereover can both be moved laterally by the lateral movement means.

BRIEF DESCRIPTION OF THE DRAWINGS

One embodiment of the invention is schematically illustrated in the accompanying drawings.

DESCRIPTION OF THE PREFERRED EMBODIMENTS

Between the side frames 1, 2 of the sheet feeder, there is positioned a sheet stack 3 which can be raised by a stack raising device, until the uppermost sheet of the stack is grasped by the suction devices of the sheet feeder. The uppermost sheet can then be transported into the printing press. As soon as the sheet stack has been processed, the paper feed to the printing press is turned off and the stack raising device is lowered far enough so that a new sheet stack 3 can be introduced.

Sheet stack raising devices are well known in the art and are disclosed in, for example, U.S. Pat. No. 4,830,354, issued on May 16, 1989 and entitled "Sheet Feed Apparatus and Cartridge Therefor"; U.S. Pat. No. 4,560,157, issued and entitled "Transport Device for Individual Sheets to be Combined into a Stack"; U.S. Pat. No. 4,245,830, issued on Jan. 20, 1981 and entitled "Correction of Transverse Offset of Sheets in Sheet Feeding Unit"; and U.S. Pat. No. 4,219,192, issued on Aug. 26, 1980 and entitled "Sheet Loading and Storing Assembly."

Suction devices for transporting individual sheets of paper into a printing press are similarly well known in the art and are disclosed in, for example, in U.S. Pat. No. 4,580,773, issued on Apr. 8, 1986 and entitled "Sheet-Seeking Suction Foot for Combined Sheet Separation and Forwarding in a Small Printing Press"; U.S. Pat. No. 4,002,332, issued Jan. 11, 1977 and entitled "Automatic Feed Mechanism for Power Brake or the Like"; U.S. Pat. No. 4,090,702 entitled "Suction Air Control Device for Use with Sheet Feeds"; and U.S. Pat. No. 3,938,800 entitled "Suction Head for Sheet Feeding Apparatus.

Figure 2:
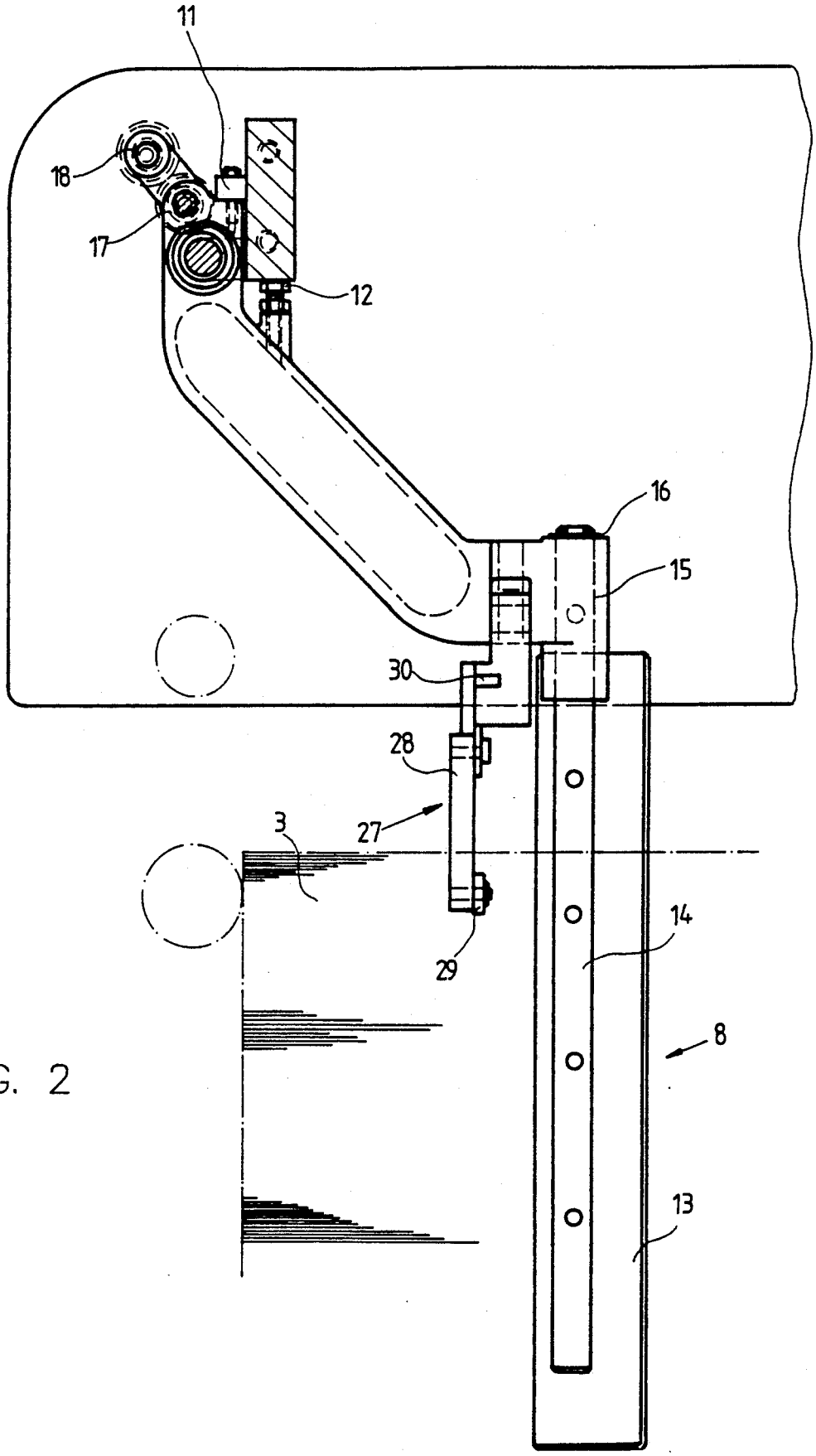
FIG. 2 is an elevational view of a stack stop.

Between the side frames 1, 2 there is provided a crosspiece 4 at right angles to the sheet transport direction, which is fastened to the side frames 1, 2 on both sides by means of screws 5. Fastened to the crosspiece 4 are guide rails 6, on which the stack stops 7, 8 are mounted so that they can be moved in a lateral direction. Holder arms 9, 10 are mounted on the guide rails 6 for movement thereon, and are each supported by a stop 11 on the crosspiece 4. As shown most clearly in FIG. 2, there are also provided set screws 12 on the holder arms 9, 10, which can be adjusted in relation to the crosspiece 4 so that only pendulum motion of the stack stops 7, 8 is effectively prevented. In the illustrated example, the stack stops 7, 8 each consist of a stop strip 13, which is fastened to a slideway 14. The slideways 14 are guided in a sliding seat 15 provided in the lower region of the holder arms 9, 10, and can be moved upward in relation to the holder arms 9, 10. In other words, the stop strips 13 can be moved vertically with respect to the holder arms 9, 10. The movement of each of the slideways 14 downward is limited by a retaining ring 16 (FIG. 2). It is thereby possible that the two stack stops 7, 8 can be moved upward when they make impact, e.g., on the stack raising device. The length of the stop strips 13 and of the slideways 14 is preferably designed such that the stop strips 13 cover the greater portion of the sheet stack height. In one embodiment, this length is approximately 50% of the maximum height of the sheet stack.

Each holder arm 8, 9 has, in its upper vicinity, an projecting extension 17, 18, which is provided with a threaded hole there through. Engaged in these threaded holes are threaded spindles 19, 20, which are rotationally mounted in bearings mounted on the side frame 2 so that they can rotate. Retaining rings 22 prevent the threaded spindles 19, 20 from moving axially. Outside the side frame 2, a drive wheel 23 is fastened to each threaded spindle 19, 20. The drive wheel 23 is coupled by means of another drive wheel 24 to a pair of servomotors 25, 26. Activation of the servomotors 25, 26 imparts a rotational movement to the threaded spindles 19, 20, and thus moves the holder arms 9, 10 and thereby the stack stops 7, 8 on the guide rails 6. It thereby becomes possible to move the stack stops 7, 8 to the sides of the sheet stack 3, regardless of what sheet format is being printed in the notary printing press.

Figure 1:
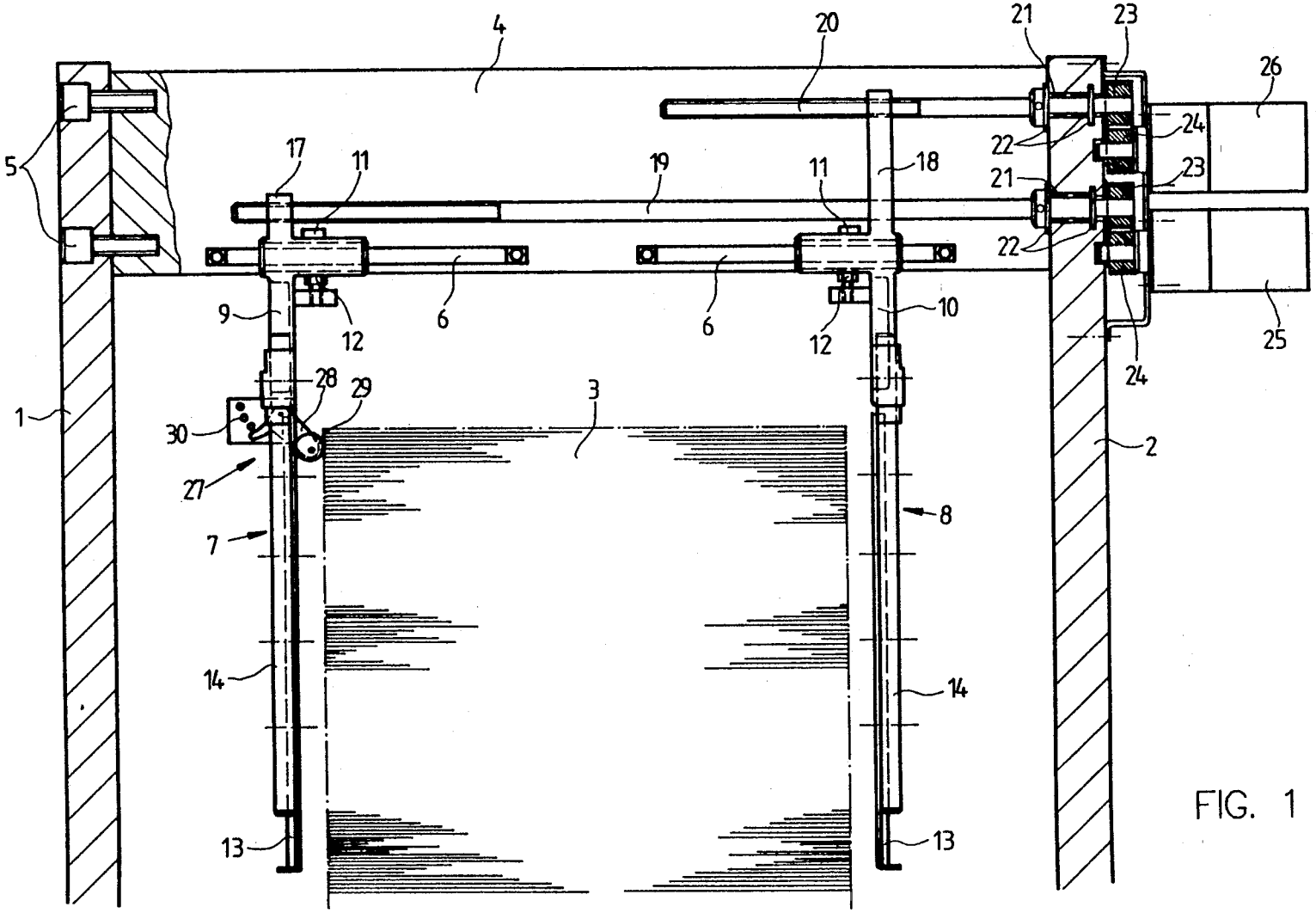
FIG. 1 is a partial cross sectional view through a sheet feeder.

In the embodiment illustrated in FIGS. 1 and 2, a sensing device 27 is preferably fastened to one holder arm 9. The sensing device 27 consists of a sensing roller 29 mounted on a lock-and-release lever 28, and a signalling device for example, a photo electric sensing apparatus. By means of the sensing device 27, the lateral position of the sheet stack 3 can be monitored and, if necessary, corrected by a lateral movement of the sheet stack 3.

Sensing devices in general, and more particularly photo electric sensing devices used in the printing arts, are well known. One photo electric sensing device is disclosed in U.S. Pat. No. 3,902,713, issued on Sep. 2, 1975 and entitled "Photoelectric Stack Height Detection Device."

In the event of a change in the format to be printed, the lateral stack stops 7, 8 can be set to the new format by means of the servomotors 25, 26. Such a change can be easily automatically programmed by means well known in the art, such as a programmable microcomputer, e.g., a "programmable controller". Independently, the lateral stack stops 7, 8 can also be moved manually into any desired position.

To give the printer the opportunity to fill up the sheet stack in the press, that is, to enable the operator to replenish the sheet supply by placing new sheet layers on the remaining stack, the invention also proposes the following sequence of operations: For the above mentioned prestacking in the sheet feeder, when the paper feed to the printing press is shut off, first the remaining stack is lowered, to create sufficient space above the sheet stack 3 for the new sheet layers. Then the lateral stack stops 7, 8 are placed against the remaining stack by means of the positioning means 19, 20, 25, 26. This can be done manually or automatically by means of a program circuit, e.g., a programmable controller, while the paper feed is turned off. The printer can insert the new sheets by hand between the stack stops 7, 8 and straighten and align them with the remaining stack. The straightening of the sheets is automatically ensured by the positioning of stack stops 7, 8 being in contact with the remaining stack. Then, e.g., by pressing a button, the sheet stack 3 is raised into the working position by the stack raising and lowering apparatus described above, and simultaneously the stack stops 7, 8 are moved a specified distance away from the sheet stack 3. It is normally sufficient to move the stack stops 7, 8 only a few centimeters from the lateral edges of the sheet stack. That makes it possible for the sheet stack 3 to be moved laterally, e.g., if the lateral straightening of the sheet stack 3 is done by the sensing device 27.

Figure 3:
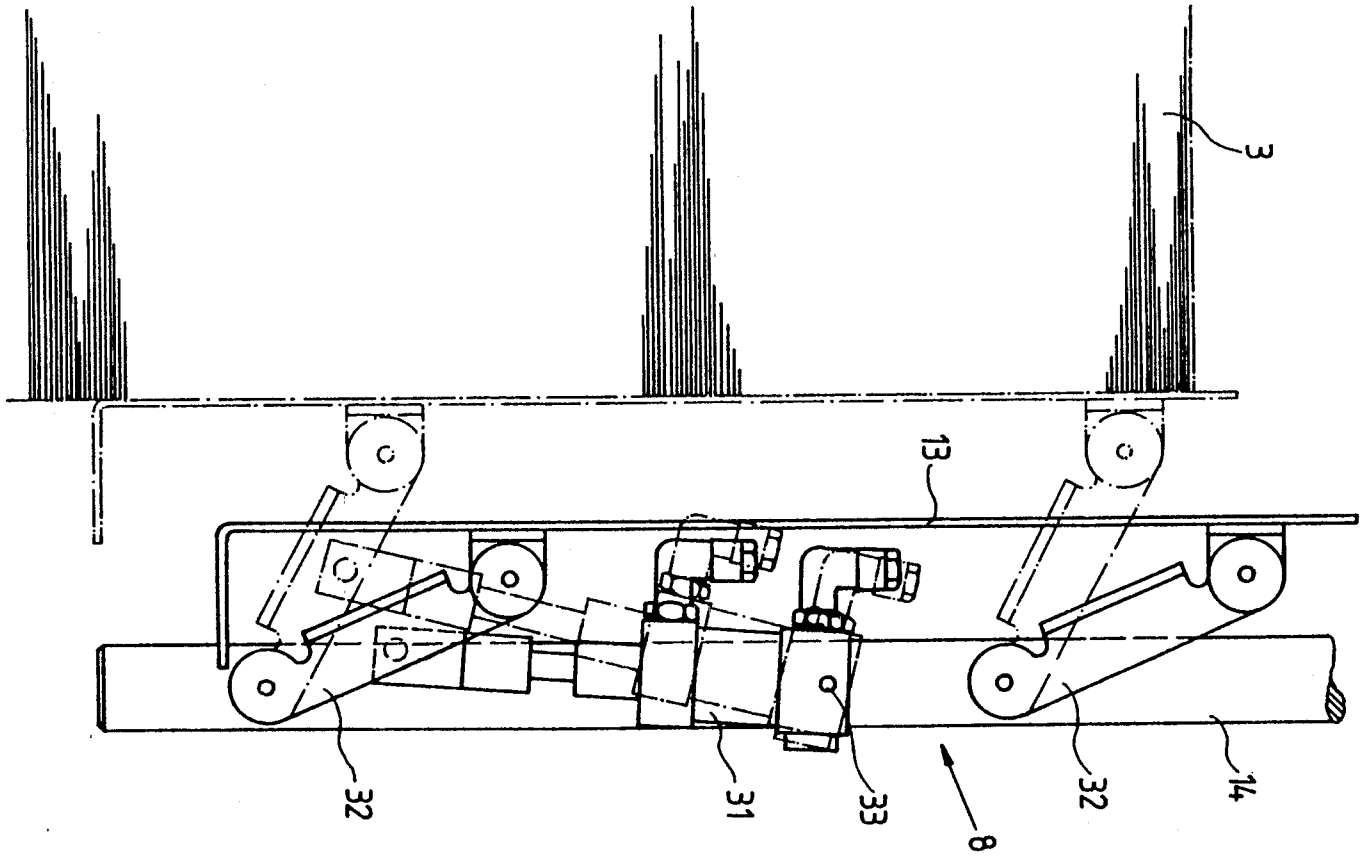
FIG. 3 is an elevational view of an alternative embodiment of a stack stop.

In one embodiment of the invention, the stops 7, 8 can be moved separately by hand on the guide rails 6, and then clamped in the working position. To make this task easier, there are provided graduated scale markings to set the format (i.e., the sheet size) on the guide rails 6. In an embodiment shown in FIG. 3, the stop strips 13 may be adjustably mounted by means of positioning means, e.g., a hydraulically or pneumatically activated cylinder 31, thereby being horizontally adjustable with respect to the slideways 14, so that the stop strips 13 can be moved against the sheet stack 3, or can be alternatively moved several centimeters away from it. The mounting of the stop strips 13 on the slideways 14 is preferably by means of two lock-and- release levers 32. The cylinder 31 can engage one of the lock- and-release levers, and is fastened to the slideway 14 by means of a bolt 33. In FIG. 3, the position of the stop strip 13 on the sheet stack 3 is indicated in dashed lines.

Figure 4:
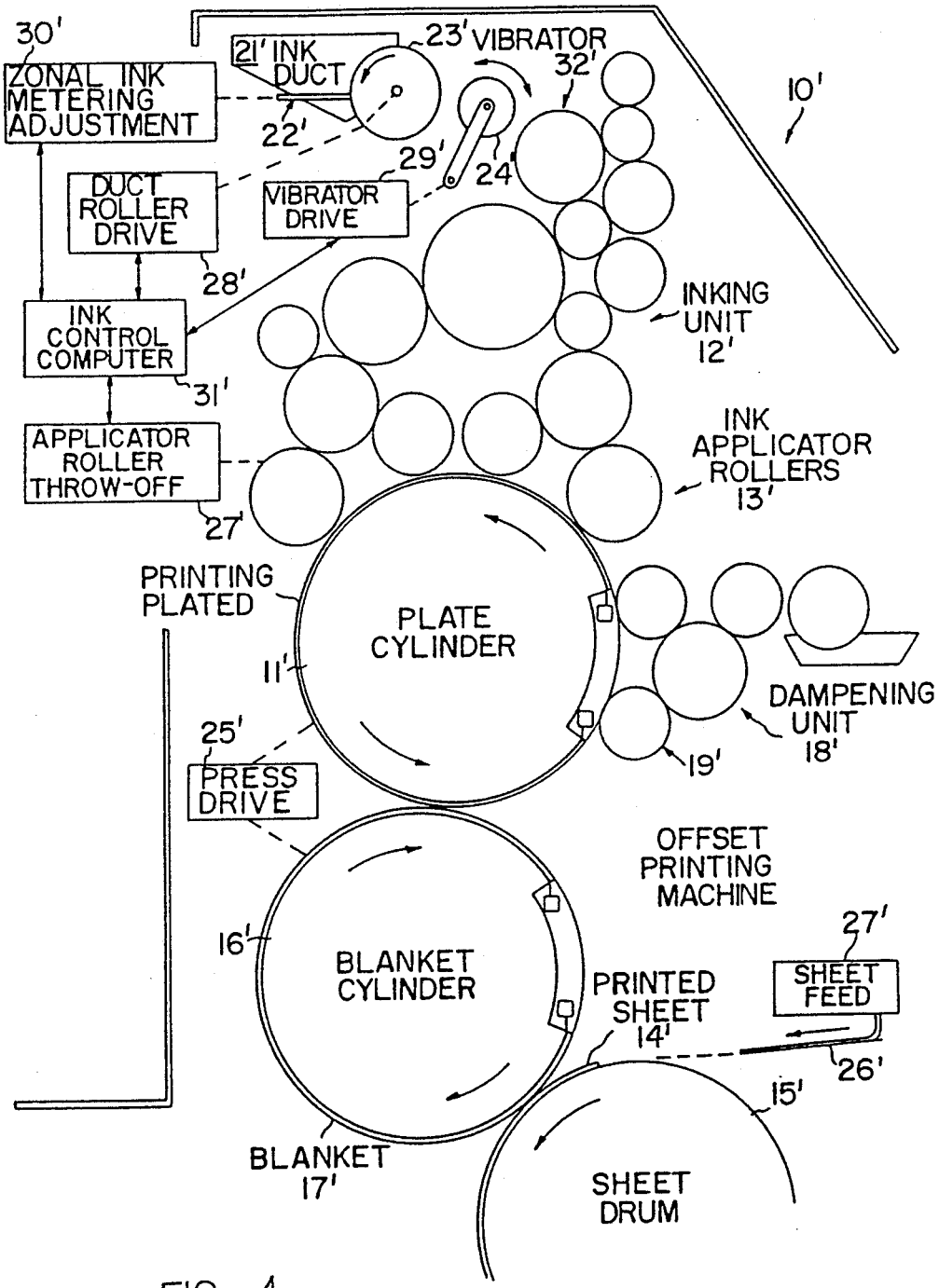
FIG. 4 is a schematic representation of a rotary printing press of the type which the present invention is designed to be used in conjunction therewith.

Referring now to FIG. 4, a rotary print stand 10', well known in the art, generally includes: a plate cylinder 11' having mounted thereon a printing plate D'; an inking unit 12' which includes ink applicator rollers 13' for applying to printing plate D' an ink profile of a single color printing ink (for example, black, cyan, magenta or yellow); a unit 18' having wetting applicator rollers 19' for transferring a wetting agent to printing plate D'; a blanket cylinder 16' carrying a rubber blanket 17' for receiving an ink impression from printing plate D'; and a sheet drum 15' for carrying a printed sheet 14' onto which the ink impression carried by blanket 17' is transferred.

It is particularly important that the ink be applied to printing plate D' in a precisely defined and controllable manner. That is, those areas of printing plate D' having a high density of printed content will require a greater ink flow during the printing process than those areas having a lower density of printed content. To this end, the printing stand 10' is typically provided with a means for zonally varying the ink application profile across the width of the printing stand 10' For example, as shown in FIG. 1, printing stand 10' may be provided with an ink duct 21' which extends across its width. The zonal adjustment of the ink application profile is provided by a plurality of ink metering ducts 22' which may be controlled or adjusted by a zonal ink metering adjustment mechanism 30' under the control of a computer 31'.

A duct roller 23' is typically mounted adjacent to ink duct 21'. An ink duct of this type is further described in U.S. Pat. No. 3,978,788, issued Sep. 7, 1976.

Typically, the ink application profile which is set up on duct roller 23' is transferred into the inking unit 12' by means of a vibrator roller 24' which oscillates to successively pick up strips of ink from duct roller 23' and transfer them into inking unit 12', as for example, by contacting one of the rollers 32' thereof. The operation of such a vibrator roller 24' is more fully described in U.S. Pat. No. 3,908,545, issued Sep. 30, 1975.

Typically, the printing stand 10' will also include auxiliary mechanisms such as, for example, a duct roller drive 28', a vibrator roller drive 29', an applicator roller throw-off 27' for lifting the ink applicator rollers 13' off of the printing plate D', a press drive 25' and a sheet feed 27' for supplying the sheets to be printed 26' to sheet drive drum 15'

Figure 5:
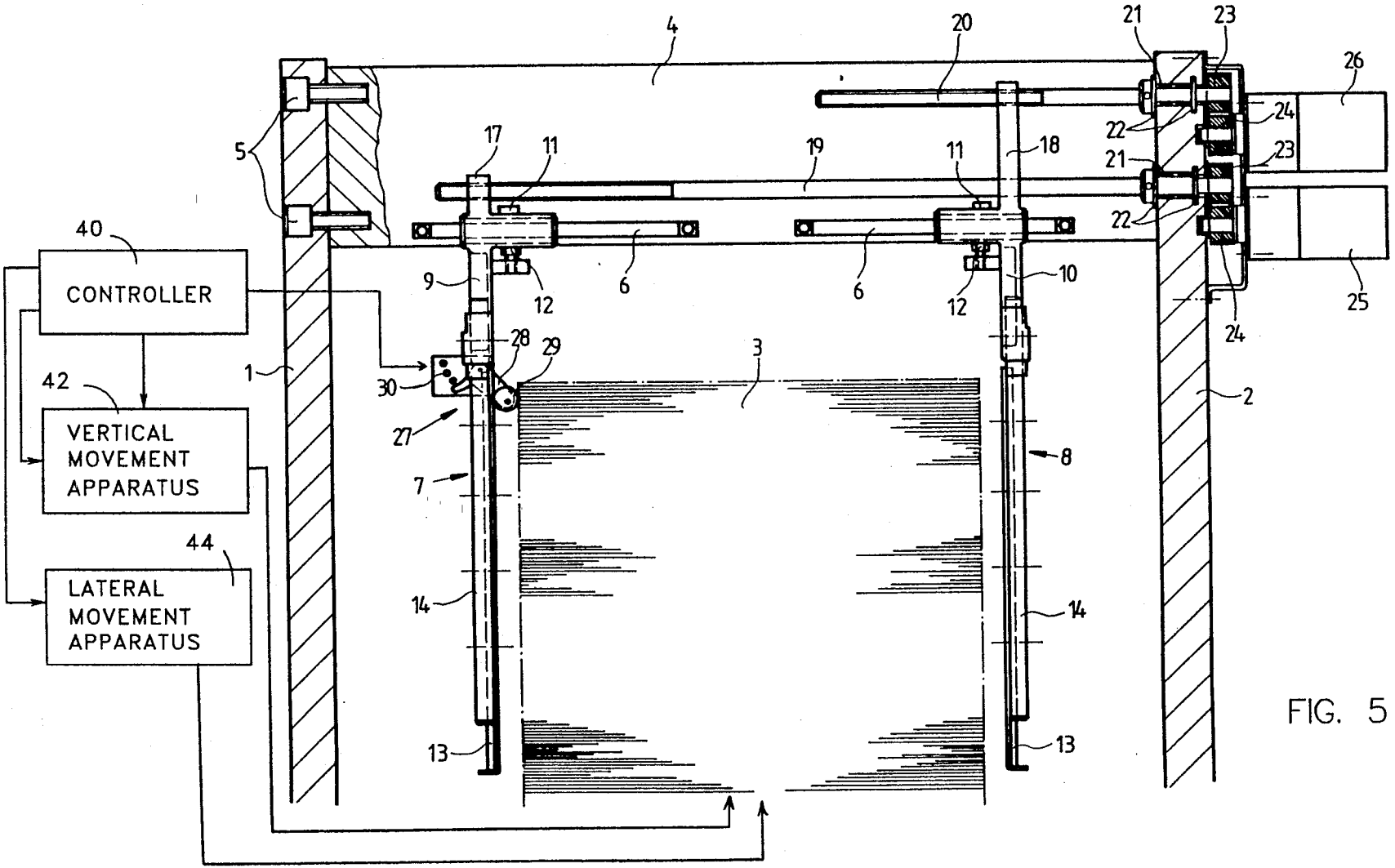
FIG. 5 is similar to FIG. 1, but shows additional components described below.

FIG. 5 is similar to FIG. 1, but shows certain components not shown in therein but referred to above. More particularly, there is shown in FIG. 5 a vertical movement apparatus 42, for example, such as the sheet stack raising devices well known in the prior art and disclosed in the U.S. patents listed above.

Also shown in FIG. 5 is a lateral movement apparatus 44 for moving the sheet stack laterally with respect to the printing press. Such devices are also known to the prior art and are disclosed, for example, in U.S. Pat. No. 4,349,187, issued on Sep. 14, 1982 and entitled "Sheet Feeder with Nonstop Device", and in U.S. Pat. No. 4,697,804, issued on Oct. 6, 1987 and entitled "Sheet Feeder for Rotary Printing Presses".

FIG. 5 also shows a CPU or programmable controller 40 for coordinating the various process steps described above. The use of such a device and appropriate control programs to effectuate use of such a device are also well known or easily derived by one of ordinary skill in the art.

In summary, one feature of the invention resides broadly in a process for prestacking in a sheet feeder on rotary printing presses with lateral stack stops (7, 8) which can be set to the size of the sheet format to be processed, with an automatic lateral stack orientation and with a stack raising apparatus—in which first, with the paper feed turned off, the remaining stack is first lowered, then the lateral stack stops (7, 8) are placed against the remaining stack by means of positioning means (19, 20, 25, 26), the new sheet layers are manually inserted between the stack stops (7, 8) and are placed after straightening on the remaining stack, and the sheet stack (3) is raised into the working position, and simultaneously the stack-stops (7, 8) are moved away from the sheet stack (3) by a desired amount, so that the sheet stack (3) can be moved laterally.

Another feature of the invention resides broadly in a process according to claim 1, characterized by the fact that the lateral position of the sheet stack (3) is monitored by a sensing device (27).

Yet another feature of the invention resides broadly in a process according to claim 1, characterized by the fact that the format adjustment of the lateral stack stops (7, 8) is made by means of their positioning means (19, 20, 25, 26).

A further feature of the invention resides broadly in an apparatus for the execution of the process disclosed in claim 1, characterized by the fact that the lateral stack stops (7, 8) are mounted so that they can be moved on a crosspiece (4) at right angles to the sheet transport direction, that each stop (7, 8) can be moved separately by means of a threaded spindle (19, 20) and a servomotor (25, 26), and that the stack stops (7, 8) can be moved horizontally in a slideway (14), and are each mounted on a holder arm (9, 10), and cover the majority of the stack height.

A yet further feature of the invention resides broadly in an apparatus according to claim 10, characterized by the fact that each stop (7, 8) can be separately moved and clamped manually on guide rails (6), that the guide rails (6) have graduated scale markings for setting the format, and that the stop strips (13) can be moved away from the sheet stack (3) by means of positioning means.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. Process for the replenishing of an existing stack of sheets of paper, the sheets of paper being fed to a rotary printing press in a defined direction of sheet transport for the printing thereof, the sheets of paper being supplied to the printing press in the form of a substantially vertical stack having opposing lateral sides, and the printing press being provided with conveying means for conveying an uppermost sheet of paper from the stack into the printing press, vertical movement means for moving the stack in a substantially vertical direction, lateral movement means for moving the stack in a substantially lateral direction with respect to the rotary printing press, and at least a pair of lateral stack stops, the lateral stack stops extending substantially vertically, one each of the pair of lateral stack stops aligning with an opposing lateral side of the stack, said process comprising the steps of:

actuating the vertical movement means to thereby lower the existing stack;

positioning each of the pair of lateral stack stops against the respective opposing lateral side of the existing stack and in contact therewith;

forming a plurality of additional sheets into an additional stack, said additional stack also having opposing lateral sides, and placing said additional stack of top of the existing stack and between the pair of lateral stack stops, such that each of the lateral sides of the additional stack is in contact with the opposing lateral stack stop;

actuating the vertical movement means to thereby raise the stack, including the existing stack with the additional stack being thusly positioned thereover; and moving each of the pair of lateral stack stops so that they are positioned away from and out of contact with the opposing lateral sides of both the existing stack and the additional stack positioned thereover, whereby both the existing stack and the additional stack positioned thereover can both be moved laterally by the lateral movement means.

2. The process according to claim 1, wherein said process further comprises the additional steps of:

sensing the lateral positioning of at least one sheet of paper located adjacent the top of a combined stack comprising the existing stack and the additional stack; and actuating the lateral movement means to bring the at least one sheet of paper substantially into a predetermined lateral position relative to the rotary printing press.

3. The process according to claim 2, wherein said step of positioning each of the pair of lateral stack stops against the respective opposing lateral side of the existing stack and in contact therewith is carried out by transverse movement means for independently moving each of the pair of lateral stack stops laterally with respect to the printing press;

said process further comprising the additional steps of:

providing a first threaded spindle extending substantially transverse to said direction of sheet transport and threadingly engaging a first of said pair of lateral stack stops;

providing a first servomotor for rotating said first threaded spindle;

providing a second threaded spindle extending substantially transverse to said direction of sheet transport and threadingly engaging a second of said pair of lateral stack stops; and providing a second servomotor for rotating said second threaded spindle; and said transverse movement means comprises:

said first threaded spindle, said first servomotor, said second threaded spindle, and said second servomotor.

4. The process according to claim 3, said process further comprising the additional steps of:

providing for each of the pair of lateral stack stops a holder arm member, said holder arm member being provided with threaded engagement means for threadingly engaging said respective threaded spindle;

providing for each of the pair of lateral stack stops a stop strip member for contacting the lateral sides of the existing and additional stacks; and providing for each of the pair of lateral stack stops means for moving said stop strip member, relative to said holder arm member, in a vertical direction;

wherein each of said pair of lateral stack stops comprises:

one of said holder arm members, one of said stop strip members, and one of said means for moving said stop strip member.

5. The process according to claim 4, said process further comprising the additional step of providing a sliding engagement between said stop strip member and said holder arm member;

wherein said means for moving said stop strip member in a vertical direction relative to said holder arm member comprises said sliding engagement; and said providing said stop strip members comprises providing stop strip members having a length greater than 50% of the total combined vertical heights of said existing stack and said additional stack.

6. Apparatus for the replenishing of an existing stack of sheets of paper supplied to a rotary printing press for the printing thereof, the sheets of paper being supplied to the printing press in the form of a substantially vertical stack having opposing lateral sides, the rotary printing press being provided with conveying means for conveying an uppermost sheet of paper from the stack into the printing press in a defined direction of sheet transport, said apparatus comprising:

vertical movement means for moving the stack in a substantially vertical direction;

alignment means for aligning an additional stack of sheets on top of the existing stack by aligning the opposing lateral sides of the additional stack with the opposing lateral sides of the existing stack;

said alignment means comprising:

at least a pair of lateral stack stops, the lateral stack stops extending substantially vertically, the pair of lateral stack stops facing opposing lateral sides of the existing stack; and means for positioning said pair of lateral stack stops;

said means for positioning being configured to position said pair of lateral stack stops in:

a first position against the respective opposing lateral side of the existing stack and in contact therewith, and a second position away from and out of contact with the opposing lateral sides of both the existing stack and the additional stack positioned on top of the existing stack, thereby permitting both the existing stack and the additional stack positioned thereon both to be moved laterally without interfering with said pair of lateral stack stops;

said pair of lateral stack stops and said positioning means both being configured to provide in said first position a lateral force on the additional stack to align the additional stack with the existing stack upon positioning the additional stack on top of the existing stack;

said means for positioning said pair of lateral stack stops in said first and second positions comprising transverse movement means for moving each of said pair of lateral stack stops in a direction substantially transverse to said direction of sheet transport;

said transverse movement means comprising:

a cross member mounted substantially transverse to said direction of sheet transport;

a pair of guide rails mounted on said cross member and extending substantially transverse to said direction of sheet transport; and a pair of holder arm members, one each of said holder arm members being slidingly mounted on one each of said guide rails;

said pair of lateral stack stops comprising a pair of stop strip members, a first of said stop strip members being attached to a first of said holder arm members, a second of said stop strip members being attached to a second of said holder arm members, and said stop strip members extending over at least a substantial portion of the additional stack and over a portion of the existing stack;

said transverse movement means further comprising means for moving said first stop strip member relative to said first holder arm member and in a direction substantially transverse to said direction of sheet transport, and moving said second stop strip member relative to said second holder arm member and in a direction substantially transverse to said direction of sheet transport;

said first stop strip member being connected to said first holder arm member by at least a first lock and release lever arm;

said second stop strip member being connected to said second holder arm member by at least a second lock and release lever arm;

said means for moving said first stop strip member and said second stop strip member comprising a pair of pneumatic cylinders, one each of said pair of pneumatic cylinders being mounted on one each of said holder arm members;

said stop strip members extending over at least a substantial portion of the existing stack;

the length of each of said stop strip members being greater than 50% of the total combined vertical heights of said existing stack and said additional stack; and each of said guide rails being provided with graduated markings indicative of a format size of the stack.

7. Apparatus for the replenishing of an existing stack of sheets of paper supplied to a rotary printing press for the printing thereof, the sheets of paper being supplied to the printing press in the form of a substantially vertical stack having opposing lateral sides, the rotary printing press being provided with conveying means for conveying an uppermost sheet of paper from the stack into the printing press in a defined direction of sheet transport, said apparatus comprising:

vertical movement means for moving the stack in a substantially vertical direction;

alignment means for aligning an additional stack of sheets on top of the existing stack by aligning the opposing lateral sides of the additional stack with the opposing lateral sides of the existing stack;

said alignment means comprising:

at least a pair of lateral stack stops, the lateral stack stops extending substantially vertically, the pair of lateral stack stops facing opposing lateral sides of the existing stack; and means for positioning said pair of lateral stack stops;

said means for positioning being configured to position said pair of lateral stack stops in:

a first position against the respective opposing lateral side of the existing stack and in contact therewith, and a second position away from and out of contact with the opposing lateral sides of both the existing stack and the additional stack positioned on top of the existing stack, thereby permitting both the existing stack and the additional stack positioned thereon both to be moved laterally without interfering with said pair of lateral stack stops;

said pair of lateral stack stops and said positioning means both being configured to provide in said first position a lateral force on the additional stack to align the additional stack with the existing stack upon positioning the additional stack on top of the existing stack;

said means for positioning said pair of lateral stack stops in said first and second positions comprising transverse movement means for moving each of said pair of lateral stack stops in a direction substantially transverses to said direction of sheet transport;

said transverse movement means comprising:

a cross member mounted substantially transverse to said direction of sheet transport;

a pair of guide rails mounted on said cross member and extending substantially transverse to said direction of sheet transport; and a pair of holder arm members, one each of said holder arm members being slidingly mounted on one each of said guide rails;

said pair of lateral stack stops comprising a pair of stop strip members, a first of said stop strip members being attached to a first of said holder arm members, a second of said stop strip members being attached to a second of said holder arm members, and said stop strip members extending over at least a substantial portion of the additional stack and over a portion of the existing stack;

said transverse movement means further comprising:

a first threaded spindle threadingly engaging said first of said pair of holder arm members;

a second threaded spindle threadingly engaging said second of said pair of holder arm members; and motor means for rotatingly driving said first and second threaded spindles to thereby displace said first and second holder arm members along said associated guide rails in said direction substantially transverse to said direction of sheet transport.

8. The apparatus according to claim 7, wherein said apparatus additionally comprises means for moving said first stop strip member in a substantially vertical direction with respect to said first holder arm member, and moving said second stop strip member in a substantially vertical direction with respect to said second holder arm member.

9. The apparatus according to claim 8, wherein said means for moving said first stop strip member in a substantially vertical direction with respect to said first holder arm member, and moving said second stop strip member in a substantially vertical direction with respect to said second holder arm member comprises:

a slideway member attached to each of said pair of stop strip members;

a sliding seat provided in each of said holder arm members, one each of said slideway members slidingly engaging one each of said holder arm members, whereby each of said slideway members, with said attached stop strip member, can be vertically displaced with respect to said slidingly engaged slideway seat; and a pair of retaining rings, one each of said pair of retaining rings engaging a distal end of one of said pair of slideway members to thereby limit the vertical displacement of said slideway members with respect to said slidingly engaged slideway seats.

10. The apparatus according to claim 9, wherein said apparatus additionally comprises:

a pair of length adjustable set screws, one each of said pair of length adjustable set screws being provided on one each of said holder arm members, each of said length adjustable set screws contacting said cross member mounted substantially transverse to said direction of sheet transport, whereby pendular motion of said holder arm members in a direction substantially along said direction of sheet transport may be substantially reduced;

a pair of stops, said pair of stops being mounted on said cross member, and one each of said stops contacting one of said pair of holder arm members; and sensing means for sensing the lateral positioning of at least one sheet of paper located within the stack; said sensing means comprises:

a sensing roller for contacting at least one sheet of paper located within the stack;

a lever arm pivotally mounted on one of said pair of holder arm members, said lever arm pivoting within a plane of travel which is substantially transverse to the direction of sheet transport;

said sensing roller being mounted on said pivotally mounted lever arm; and photoelectric sensing means for sensing the disposition of said lever arm;

said motor means for rotatingly driving said first and second threaded spindles comprises:

first servomotor means for rotatingly driving said first threaded spindle;

second servomotor means for rotatingly driving said second threaded spindle;

a first drive wheel attached to said first threaded spindle;

a second drive wheel rotationally driven by said first servomotor means and engaging said first drive wheel;

a third drive wheel attached to said second threaded spindle; and a fourth drive wheel rotationally driven by said second servomotor means and engaging said third drive wheel;

the rotary printing press is provided with a pair of side frame members;

said cross member extends between said pair of side frame members and is secured to at least one of said pair of side frame members by at least a pair of screws;

said first and second servomotor means are mounted on the other of said pair of side frame members;

said apparatus additionally comprises:

a first rotational bearing extending through said other side frame member, said first threaded spindle being rotationally supported by said first rotational bearing;

a first pair of retaining rings positioned on opposite sides of said first rotational bearing and surrounding said first threaded spindle;

a second rotational bearing extending through said other side frame member, said second threaded spindle being rotationally supported by said second rotational bearing; and a second pair of retaining rings positioned on opposite sides of said second rotational bearing and surrounding said second threaded spindle;

said stop strip members extend over at least a substantial portion of the existing stack;

the length of each of said stop strip members is greater than 50% of the total combined vertical heights of said existing stack and said additional stack; and each of said guide rails is provided with graduated markings indicative of a format size of the stack.

11. Process for the replenishing of an existing stack of sheets of paper, the sheets of paper being fed to a rotary printing press in a defined direction of sheet transport for the printing thereof, the sheets of paper being supplied to the printing press in the form of a substantially vertical stack having opposing lateral sides, and the printing press being provided with conveying means for conveying an uppermost sheet of paper from the stack into the printing press, vertical movement means for moving the stack in a substantially vertical direction, and at least a pair of lateral stack stops, the lateral stack stops extending substantially vertically, one each of the pair of lateral stack stops aligning with an opposing lateral side of the stack, said process comprising the steps of:

actuating the vertical movement means to thereby lower the existing stack;

positioning each of the pair of lateral stack stops against the respective opposing lateral side of the existing stack and in contact therewith;

forming a plurality of additional sheets into an additional stack, said additional stack also having opposing lateral sides, and placing said additional stack on top of the existing stack and between the pair of lateral stack stops, such that each of the lateral sides of the additional stack is in contact with the opposing lateral stack stop;

actuating the vertical movement means to thereby raise the stack, including the existing stack with the additional stack being thusly positioned thereover; and moving each of the pair of lateral stack stops so that they are positioned away from and out of contact with the opposing lateral sides of both the existing stack and the additional stack positioned thereover.

12. The process according to claim 11, said process further comprising the additional step of:

sensing the lateral positioning of at least one sheet of paper located adjacent the top of a combined stack comprising the existing stack and the additional stack.

13. The process according to claim 12, wherein said step of positioning each of the pair of lateral stack stops against the respective opposing lateral side of the existing stack and in contact therewith is carried out by transverse movement means for independently moving each of the pair of lateral stack stops laterally with respect to the printing press.

14. The process according to claim 13, said process further comprising the additional steps of:

providing a first threaded spindle extending substantially transverse to said direction of sheet transport and threadingly engaging a first of said pair of lateral stack stops;

providing a first servomotor for rotating said first threaded spindle;

providing a second threaded spindle extending substantially transverse to said direction of sheet transport and threadingly engaging a second of said pair of lateral stack stops; and providing a second servomotor for rotating said second threaded spindle;

wherein said transverse movement means comprises:

said first threaded spindle, said first servomotor, said second threaded spindle, and said second servomotor.

15. The process according to claim 14, said process further comprising the additional steps of:

providing for each of said pair of lateral stack stops a holder arm member, said holder arm member being provided with threaded engagement means for threadingly engaging said respective threaded spindle;

providing for each of said pair of lateral stack stops a stop strip member for contacting the lateral sides of the existing and additional stacks; and providing for each of said pair of lateral stack stops means for moving said stop strip member, relative to said holder arm member, in a vertical direction;

wherein each of said pair of lateral stack stops comprises:

one of said holder arm members, one of said stop strip members, and one of said means for moving said stop strip member.

16. The process according to claim 15, said process further comprising the additional step of providing a sliding engagement between said stop strip member and said holder arm member;

wherein said means for moving said stop strip member in a vertical direction relative to said holder arm member comprises said sliding engagement.

17. The process according to claim 16, wherein said providing said stop strip members comprises providing stop strip members having a length greater than 50% of the total combined vertical heights of said existing stack and said additional stack.

* * * * *

UNITED STATES PATENT AND TRADEMARK OFFICE

CERTIFICATE OF CORRECTION

PATENT NO. : 5,240,244

DATED : August 31, 1993

INVENTOR(S) : Gerhard POLLICH and Heiner LUXEM

It is certified that error appears in the above-identified patent and that said Letters Patent is hereby corrected as shown below:

In column 4, line 22, after 'issued', insert --on December 24, 1985--.

In column 5, line 5, after 'bearings', insert --21--.

In column 11, line 52, Claim 7, after 'substantially', delete "transverses" and insert --transverse--.

Signed and Sealed this

Nineteenth Day of April, 1994

Bruce Lehman

*Attest:*

BRUCE LEHMAN

*Attesting Officer*

*Commissioner of Patents and Trademarks*